United States Patent [19]

Endo

[11] Patent Number: 4,787,103

[45] Date of Patent: Nov. 29, 1988

[54] TRAPLESS WATER FLUSH TOILET BOWL FIXTURE

[75] Inventor: Makoto Endo, Handa, Japan

[73] Assignee: INAX Corporation, Tokoname, Japan

[21] Appl. No.: 911,610

[22] Filed: Sep. 25, 1986

[30] Foreign Application Priority Data

| | | | |
|---|---|---|---|
| Oct. 11, 1985 | [JP] | Japan | 60-156067[U] |
| Nov. 25, 1985 | [JP] | Japan | 60-182111[U] |
| Nov. 29, 1985 | [JP] | Japan | 60-184954[U] |
| Apr. 1, 1986 | [JP] | Japan | 61-49233[U] |
| Jun. 3, 1986 | [JP] | Japan | 61-84366[U] |

[51] Int. Cl.[4] ..... E03D 11/10

[52] U.S. Cl. ..... 4/441; 4/440; 277/112

[58] Field of Search ..... 4/329, 331, 434–442, 4/408, 405, 412; 277/110, 11, 4, 5, 112

[56] References Cited

U.S. PATENT DOCUMENTS

| | | | |
|---|---|---|---|
| 1,052,055 | 2/1913 | Henn | 4/408 |
| 1,135,028 | 4/1915 | Kreter | 4/408 |
| 1,605,939 | 11/1926 | Haas | 4/408 |
| 1,651,901 | 12/1927 | Patterson | 4/440 X |
| 2,283,678 | 5/1942 | Landis | 4/408 |
| 2,357,967 | 9/1944 | Paloney | 277/112 |
| 2,401,098 | 5/1946 | Peter | 4/442 |
| 3,038,170 | 6/1962 | O'brien | 4/438 |
| 3,091,471 | 5/1963 | Lawless | 277/110 X |
| 3,134,569 | 5/1964 | Sidenberger et al. | 277/110 X |
| 3,308,481 | 3/1967 | O'brien et al. | 4/438 X |
| 4,032,996 | 7/1977 | Sargent et al. | 4/441 |

FOREIGN PATENT DOCUMENTS

| | | | |
|---|---|---|---|
| 5377 | 12/1881 | United Kingdom | 4/441 |

*Primary Examiner*—Charles E. Phillips
*Attorney, Agent, or Firm*—Frank J. Jordan; C. Bruce Hamburg; Manabu Kanesaka

[57] ABSTRACT

A trapless water flush toilet bowl fixture is disclosed. This fixture has: a water closet cesspool sealing member pivotally supported to shut off a waster water discharge port by impinging from underside upon this port; a sinker imparting a sufficient impingement force applied on a lower surface of the discharge port to the water closet cesspool sealing member to maintain a sealing state while resisting a load created when utilizing the same fixture; and a separating force imparting member manipulated by a manpower which member is capable of separating the sealing member from the discharge port by overcoming the impingement force. Furthermore, the trapless water flush toilet bowl fixture subsumes: a bowl having the waste water discharge port formed downwards in the bottom; a cylindrical member arranged to be nearly concentric with respect to the discharge port so that waste materials in the bowl pass therethrough and drop down, the cylindrical member having its diameter that is substantially the same as an aperture of the discharge port; and a ring-shaped seal-packing attachable to and detachable from an inner surface of the lower end of the cylindrical member; and a closing member provided at the lower end of the cylindrical member and making a seesaw motion round a fulcrum, this closing member subsuming a dish-like member which impinges from underside upon the seal-packing and a sinker installed on the opposite side to the dish-like member while interposing the fulcrum therebetween. In this constitution, the seal-packing is attachable to and detachable from the inside of the cylindrical member.

15 Claims, 21 Drawing Sheets

TRAPLESS WATER FLUSH TOILET BOWL FIXTURE

FIELD OF THE INVENTION AND RELATED ART STATEMENT

The present invention relates to a trapless water flush toilet bowl fixture suitable for a trailer, a motor home, truckmounted campers or a toilet of structures constructed in an area where sewerage is not yet provided.

One type of well known trapless water flush toilet bowl fixtures is disclosed in U.S. Pat. No. 3,599,248, this apparatus being equipped with a bowl and a ball valve provided at a waste water discharge port. It is, however found out that this type of trapless water flush toilet bowl fixture has a defect wherein the ball valve does not often hermetically shut off a water closet cesspool and the inside of the bowl.

Another type of the trapless water flush toilet bowl fixture is constructed by installing a butterfly valve at the waste water discharge port of the bowl. This type of trapless water flush toilet bowl fixture subsumes a water closet cesspool sealing member which is pivotally so supported as to impinge from the underside upon the discharge port of the bowl communicating with a draw-in type cesspool via a discharge pipe or the like. The aforementioned water closet cesspool sealing member is formed with a dish-like portion; and a sinker is attached to a portion opposite to the dish-like portion while interposing a fulcrum therebetween. Videlicet, the water closet cesspool sealing member serves as the point of application, whereas the sinker is defined as the point of force. This lever structure is determined so that the point of force is slightly heavier than the point of application; and the sinker is invested with an enough weight to press the water closet sealing member toward the waste water discharge port of the bowl. Hence, the bottom of the bowl is covered in order that a small amount of water is reserved above the water closet cesspool sealing member facing with the inside of the bowl. If a total weight of the reserved water, dirt and rinsing water is larger than the pressing force of the sinker, the water closet cesspool sealing member is opened downwards, thereby dropping the dirt and the rinsing water of the bowl down into the water closet cesspool. After the filthy water has been dropped, the point of force gains much weight again. As a result, the water closet cesspool sealing member spontaneously reverts so as to close the waste water discharge port of the bowl, whereby an offensive odor of the water closet cesspool is prevented from permeating into a toilet room.

In this trapless water flush toilet bowl fixture, when waste material is adhered to the water closet cesspool sealing member, the sealing member is left open, whereby the offensive odor of the water closet cesspool permeates into the toilet room.

OBJECT AND SUMMARY OF THE INVENTION

Accordingly, it is a primary object of the present invention to provide a trapless water flush toilet bowl fixture which is capable of sufficiently preventing an offensive odor from permeating into a toilet room.

To this end, according to another aspect of the invention, there is provided a trapless water flush toilet bowl fixture in which dirt is prevented from adhering to the inner suface of a bowl.

Other objects of the present invention will hereinafter be clarified from the following description.

The trapless water flush toilet bowl fixture according to the present invention includes: a water closet cesspool sealing member pivotally supported so that this sealing member blockades a waste water discharge port of a bowl by impinging from underside upon a lower surface of the same discharge port; a sinker imparting enough impingement force upon the lower surface of the discharge port to the aforementioned sealing member in order that a sealing state is maintained while resisting a load applied when employing the trapless water flush toilet bowl fixture; and a separating force imparting member manipulated by a manpower, this member being capable of separating the above-described sealing member from the discharge port by overcoming the impingement force.

In one embodiment of the present invention, the trapless water flush toilet bowl fixture includes: a bowl having a waste water discharge port formed downwards in a bottom portion; a cylindrical member arranged to be nearly concentric with respect to the waste water discharge port so that waste materials in the bowl pass therethrough and then drop down, the cylinder having substantially the same diameter as an aperture of the discharge port; a ring-shaped seal-packing attachable to and detachable from an inner surface of the lower end of the cylindrical member; and a closing member provided at the lower end of the cylindrical member and making a seesaw motion round a fulcrum, this closing member subsuming a dish-like member which impinges from underside upon the seal-packing and a sinker installed on the opposite side to the dish-like member while interposing the fulcrum therebetween.

BRIEF DESCRIPTION OF THE DRAWINGS

FIG. 11 is a perspective view showing a whole open-close mechanism of the water closet cesspool sealing member;

FIG. 12 is a side view showing a situation wherein an operation cable is installed on the side of the water closet cesspool sealing member;

FIG. 13 is a vertical-sectional view of FIG. 2;

FIG. 14 is a vertical-sectional view showing an operational mode of the operation cable when a tensile load that is greater than required is applied;

FIG. 16 is a perspective view showing a whole open-close mechanism of the water closet cesspool sealing member;

FIG. 17 is a side view showing a situtation in which the operation cable is installed on the side of the water closet cesspool sealing member;

FIG. 18 is a vertical sectional view showing a situation after a moving member has moved;

FIG. 19 is a vertical sectional view showing an operational mode of the operation cable when a tensile load greater than needed is applied;

FIG. 21 is a sectional view showing an installation structure of the seal-packing of the trapless water flush toilet bowl fixture according to the present invention;

FIG. 22 is a perspective view, with portions broken away, of a packing holding fittings, the seal-packing and a seal-packing attachment member;

FIGS. 23(*a*) to 23(*f*) are sectional views showing other examples of structures of a seizing groove of the seal-packing and of a seizing member of the seal-packing attachment member;

FIG. 24 is an enlarged sectional view showing a part of the trapless water flush toilet bowl fixture;

FIG. 25 is a perspective view of the packing holding fittings, the seal-packing and the packing attachment member; and FIG. 26 is a sectional view showing another mode thereof.

DETAILED DESCRIPTION OF THE PREFERRED EMBODIMENTS

Figure 1:
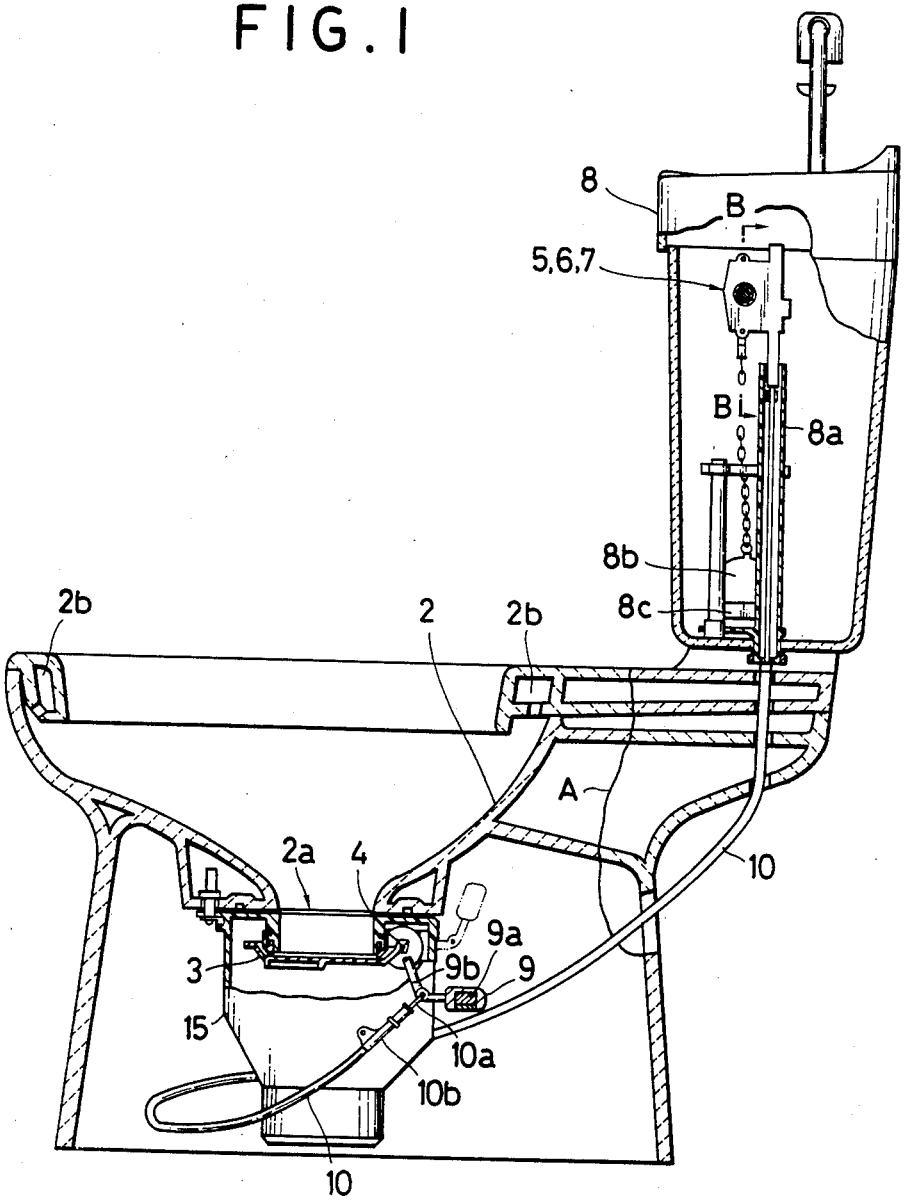
FIG. 1 is a side sectional view of a trapless water flush toilet bowl fixture of a preferred embodiment showing the same fixture body and a water-supply tank.

FIG. 1 is a side sectional view of a trapless water flush toilet bowl fixture according to the present invetion, wherein a sectional visual field on the side of the same fixture body (left in the Figure) is different from that of a water-supply tank (right in the Figure) with a cutting line A serving as the border. The trapless water flush toilet bowl fixture subsumes a water closet cesspool sealing member 3 provided at a waste water discharge port 2*a* of a bowl 2 communicating with a draw-in type cesspool through the intermediary of an evacuation pipe or the like. The water closet cesspool sealing member 3 assumes a dish-like configuration and is arranged to have a lever structure wherein a sinker 9 is connectively provided on the side of the other end thereof, with a fulcrum 4 being interposed therebetween. Videlicet, the water closet cesspool sealing member 3 serves as the point of application, whereas the aforementioned sinker 9 is defined as the point of force. This sinker 9 is considerably heavier than a load of the water closet cesspool sealing member 3 and hence the water closet cesspool sealing member 3 is intensively pushed against the waste water discharge port 2*a* formed in the bowl 2.

Figure 2:
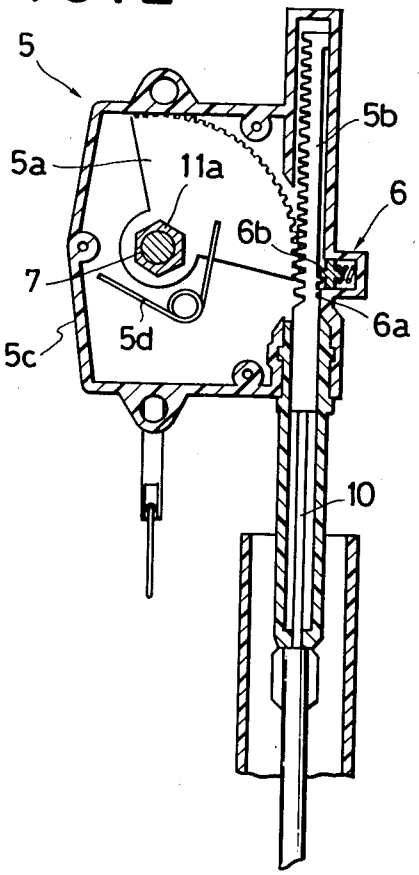
FIG. 2 is an enlarged sectional view showing a bottom-open mechanism.
Figure 4:
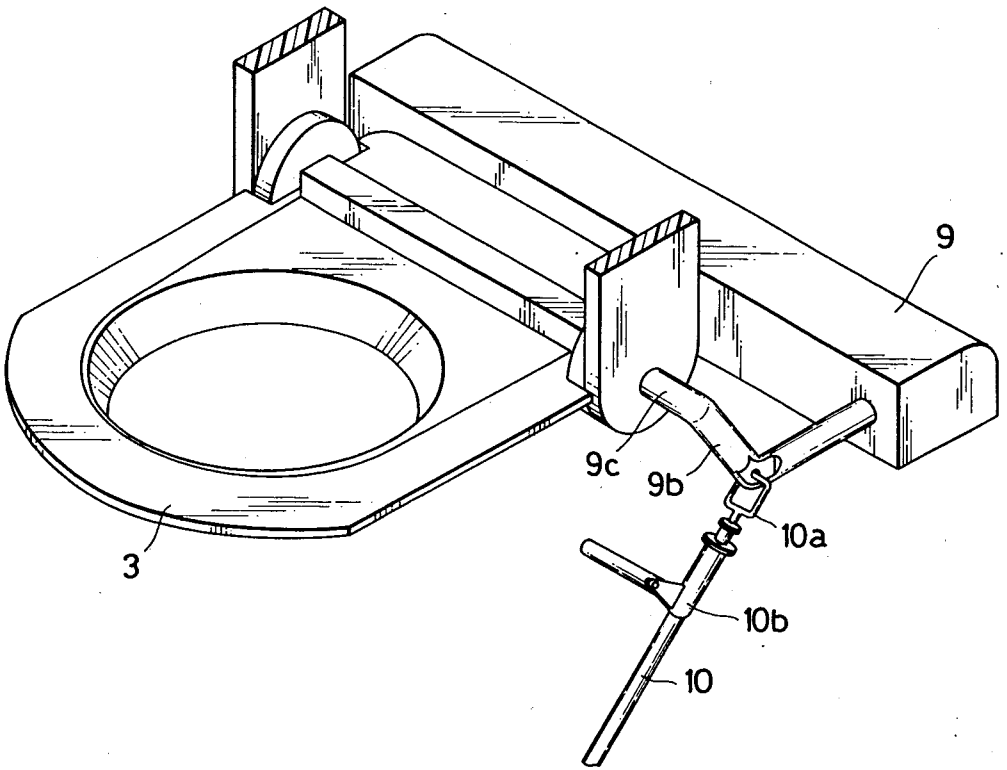
FIG. 4 is a perspective view showing a lever structure constituted by a water closet cesspool sealing member and a shut-off forcible sinker.

This trapless water flush toilet bowl fixture includes a bottom-open mechanism 5, a cut-off mechanism 6 and a water-supply mechanism 7. The bottom-open mechanism 5 is installed within a water-supply tank 8 such as a low tank provided in the vicinity of the bowl 2. FIG. 2 is a sectional view depicted so that the bottom-open mechanism 5 is enlarged and its inside is to be exposed. As illustrated in the Figure, the bottom-open mechanism 5 is constructed such that a fan-shaped pinion 5*a* engages with an axial rack 5*b* within a gear case 5*c*. A wire cable 10 is connected to the lower end of the axial rack 5*b*; and the axial rack 5*b* is, as shown in FIG. 1, linked via the wire cable 10 to a shut-off forcible sinker 9. The wire cable 10 is, as if it looks like a release of a camera (a remote controller of a shutter), slidably inserted in a tube that is flexible in curvedness. As shown in FIG. 4, the wire cable 10 is structurally linked to the shut-off forcible sinker 9 such that a ring end portion 10*a* provided at the end of the wire cable 10 is loosely fitted in an installation hole formed in a lever shaft 9*b* of the shut-off forcible sinker 9. Hence, when the above-described axial rack 5*b* (See FIG. 2) descends, the shut-off forcible sinker 9 is, as indicated by a two-dot line illustrated in FIG. 1, raised, thereby opening the aforementioned water closet cesspool sealing member 3. While on the other hand, when the axial rack 5*b* ascends, the shut-off forcible sinker 9 is lowered, thereby closing the water closet cesspool sealing member 3. It is to be noted that the above-describe wire cable 10 is protected from the water reserved in the tank by virtue of a vertical cylinder tube 8*a* which is vertically provided within the water-supply tank 8.

Figure 3:
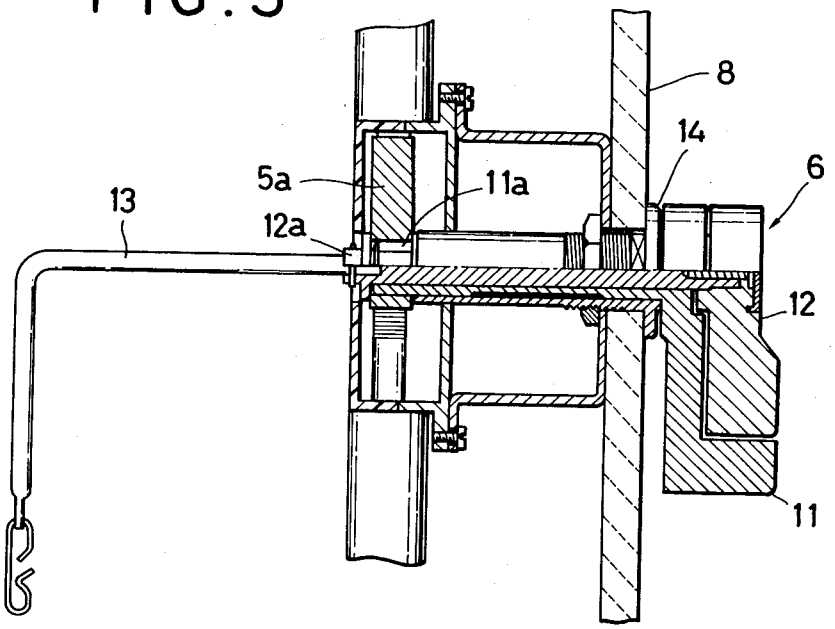
FIG. 3 is a sectional view taken substantially along the line B—B of FIG. 1.
Figure 5:
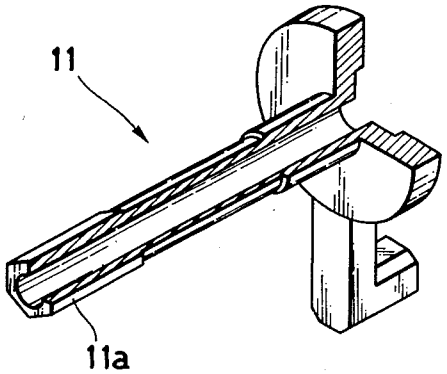
FIG. 5 is a perspective view of a bottom-open handle with portions broken away for the sake of clarity.

As depicted in FIG. 2, the aforecited fan-shaped pinion 5*a* is formed with a hexagon hole. FIG. 3 is a sectional view taken substantially along the line B—B of FIG. 1. As shown in the Figure, a shaft end portion 11*a* of a bottom-open lever 11 is inserted in the hexagon hole of the fan-shaped pinion 5*a*, the operational portion of which is so installed on the outside surface of the water-supply tank as to be exposed. The bottom-open lever is, as illustrated in FIG. 5, made hollow; and its shaft end portion 11*a* takes a hexagonal configuration in section. With this arrangement, the bottom-open lever 11 is inserted in the above-described fan-shaped pinion 5*a*, whereby the rotations of the both are intergrally restrained. The fan-shaped pinion 5*a* is, as illustrated in FIG. 2, equipped with a self-revertible torsional coil spring 5*d* in the gear case 5*c*. Therefore, upon a turn of the bottom-open lever 11, the fan-shaped pinion 5*a* rotates, and as a result, a driving force is conveyed to the axial rack 5*b* and the wire cable 10, thereby opening the above-described water closet cesspool sealing member 3. The water closet cesspool sealing member 3 is closed by dint of a reverting effect of the fan-shaped pinion 5*a* which is caused by the torsional coil spring 5*d* and of a dropping effect of the shut-off forcible sinker 9.

The cut-off mechanism 6 is, as shown in FIG. 2, so provided as to be integral with the bottom-open mechanism 5. The cut-off mechanism 6 is constituted by two or three pieces of seizing grooves 6*a* formed in the rear surface of the axial rack 5*b* and by a hook 6*b* that is biased by pressing toward the seizing grooves 6*a*. With this arrangement, when turning the bottom-open lever 11 in the direction in which the axial rack 5*b* slightly asceds, the hook 6b engages with the seizing grooves formed in the axial rack 5b, thereby locking the water closet cesspool sealing member 3 at a position where the waste water discharge port 2a of the bowl 2 is shut off.

The water-supply mechanism 7 is likewise so provided as to be integral with the above-mentioned bottom-open mechanism 5 and the cut-off mechanism 6. The water-supply mechanism, as illustrated in FIG. 3, consists of a water-supply handle 12 and a suspension shaft 13 which suspends a float valve 8b (See FIG. 1). The water-supply handle 12 has a rotary shaft 12a thereof which is inserted in a cylinder hole (See FIG. 5) formed in the bottom-open handle 11 of the bottom-open mechanism 5; and this rotary shaft 12a is rotatable separately from the bottom-open handle 11. The foregoing suspension shaft 13 is fixedly inserted in the shaft end portion of the rotary shaft 12a of the water-supply handle 12. Hence, upon a turn of the water-supply handle 12, the float valve 8b in the water-supply tank is, as illustrated in FIG. 1, raised from a valve seat 8c. As a result, the water is supplied from the water-supply tank via a rim water passage 2b provided on the upper peripheral portion of the bowl into the bowl 2.

Figure 6:
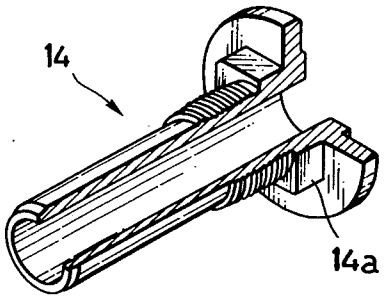
FIG. 6 is a perspective view of a housing with portions broken away for clarity.

It can be observed through FIG. 3 that the bottom-open handle 11 is installed on the side wall of the water-supply tank 8 with the aid of a cylindrical housing 14. The above-described housing 14 is, as illustrated in FIG. 6, provided with an installation base 14a which is square or like, and the rotation thereof is hindered with respect to the side wall of the water-supply tank 8.

FIG. 4 is a perspective view showing a lever structure constructed by the water closet cesspool sealing member 3 and the shut-off forcible sinker 9. The shut-off forcible sinker 9 has its plane-configuration which is longer in width than that of the water closet cesspool sealing member 3. As shown in FIG. 1, the shut-off forcible sinker 9 also subsumes a bar 9a embedded therein. The lever shaft 9b retaining the shut-off forcible sinker 9 is crookedly formed so that it inclusively performs a function of a supporting shaft 9c serving as the fulcrum 4 in the lever structure. As shown in FIG. 1, in this embodiment, inasmuch as the lever shaft 9b is crooked so that the aforementioned sinker 9 is disposed lower than the water closet cesspool sealing member 3, a load of the sinker 9 acts such as to intensivley repulse a filth load applied on the water closet cesspool sealing member 3, but much resistance is not created with respect to the push-up force by the bottom-open mechanism 5. As illustrated in FIG. 4, since the ring end portion 10a of the wire cable 10 is supported by a tube housing 10b rotatable round a cylindrical casing 15 (See FIG. 1), the wire cable 10 smoothly slides in and out of the tube.

Figure 7:
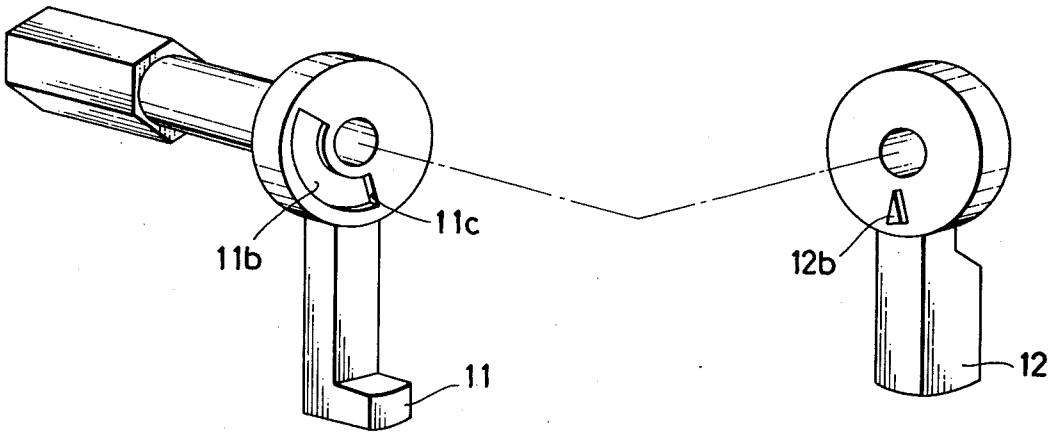
FIG. 7 is a perspective view showing the bottom handle viewed from the front and showing a water-supply handle viewed from the rear.

A triangular projection 12b is, as illustrated in FIG. 7, formed on the rear surface of the water-supply handle 12; and a quadrant recessed portion 11b is formed in the surface of the bottom-open handle 11. A forming position and a configuration of the recessed portion 11b of the bottom-open handle 11 are determined by an imaginary form depicted by the projection 12b when turning the water-supply handle 12. Consequently, when the bottom-open handle 11 and the water-supply handle 12 are combined, the projection 12b of the water-supply handle 12 is fitted in the recessed portion 11b of the bottom-open handle 11. When turning the water-supply handle 12, the projection 12b merely makes a circular arc motion within the recessed portion 11b of the bottom-open handle 11, but does not exert any influence on the bottom-open handle 11. When turning the bottom-open handle 11, however, a perpendicular stage surface 11c of the recessed portion 11b formed in the bottom-open handle 11 engages with the projection 12b of the water-supply handle 12, thereby turning the water-supply handle 12 in a follow-up manner. Accordingly, if the water is to be accumulated in the bowl, the water-supply handle 12 alone is turned; and when the bowl is cleaned after emptying the bowels, the bottom-open handle 11 alone may be turned.

Figure 8B:
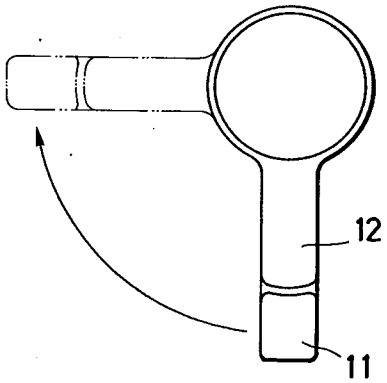
FIGS. 8(A), 8(B) are plan views of the bottom-open handle and the water-supply handle, showing an operational situation of a trapless water flush toilet bowl fixture according to the present invention.
Figure 8A:
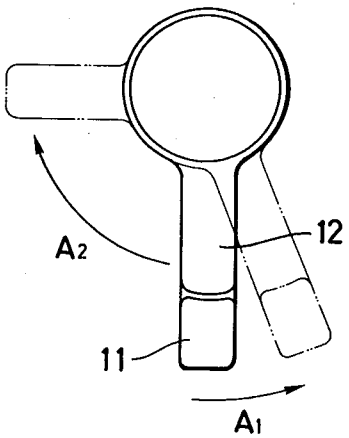

The operations of the thus constituted trapless water flush toilet bowl fixture according to the present invention will hereinafter be described with reference to FIGS. 8(A), 8(B). The bottom-open handle 11 and the water-supply handle 12 are installed on the side wall of the water-supply tank 8 (See FIG. 1), however, they are depicted from the front side thereof in FIGS. 8(A), 8(B). As shown in FIG. 8(A), on the occasion of evacuating the feces, when turning the bottom-open handle 11, as indicated by an arrowhead $A_1$, to the right hand (toward the inside of the water-supply tank 8), the hook 6b is seized to the groove 6a, and the water closet cesspool sealing member 3 (See FIG. 1) is locked at the closing position. When turning the water-supply handle 12, as indicated by an arrowhead $A_2$, to the left hand (on this side of the water-supply tank 8), a desired amount of water can be reserved in the bowl 2 (See FIG. 1). After emptying the bowels, as shown in FIG. 8(B), when turning the bottom-open handle 11 alone to the left hand (on this side), the water closet cesspool sealing member is opened, and at the same time the rinsing water is supplied into the bowl 2. On the other hand, when evacuating the bladder, as illustrated in FIG. 8(B), only the bottom-open handle 11 is turned to the left hand (on this side) after evacuation. It is to be noted that an operation to reserve the water in the bowl by employing the water-supply handle 12 is not necessarily carried out before evacuating the bowels but may be performed after emptying the bowels and rinsing the bowl.

As can be clarified from the description so far made, in the trapless water flush toilet bowl fixture according to the present invention, there is no probability for an offensive odor of the water closet cesspool to permeate in the toilet room by unnecessarily opening the water closet cesspool sealing member, inasmuch as the water closet cesspool sealing member never opens unless there is an operation by a manpower. It is feasible to accumulate the water in the bowl, the filth never frictionally passes along the inner surface of the bowl or never directly comes into contact with the water closet cesspool sealing member, whereby the filth is prevented from adhering thereto and being left thereon after rinsing the bowl.

Figure 9:
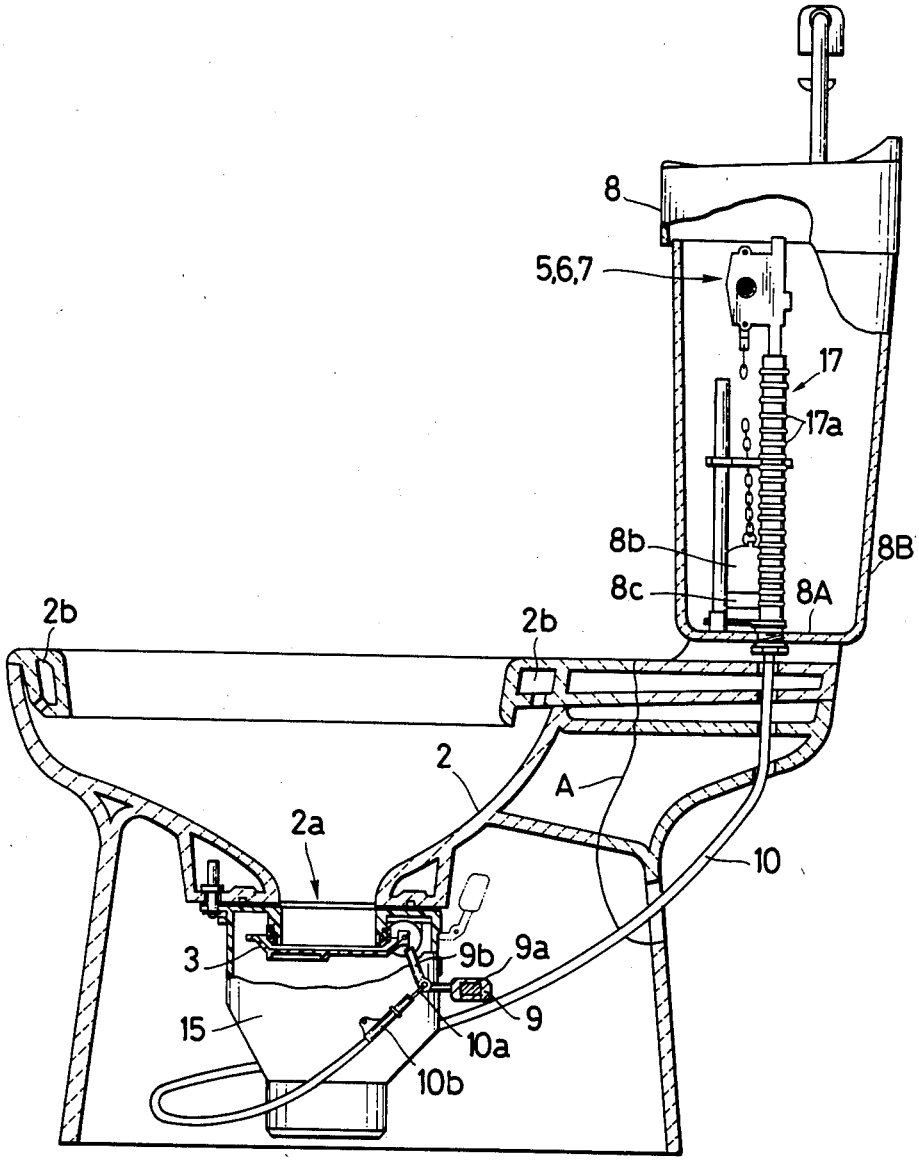
FIG. 9 is a side sectional view showing another preferred embodiment.

FIG. 9 is a side sectional view showing another embodiment; and in the Figure, the components common to those of FIGS. 1 to 8 are marked with the same numerals and symbols. In this trapless water flush toilet bowl fixture, a flexible water shut-off pipe 17 is vertically provided within the low tank 1. A wire cable 10 is inserted through the water shut-off pipe 17. The water shut-off pipe 17 is provided with a plurality of rugged or spiralled portions 17a formed on the surface thereof, appearing as if it looks like bellows on the whole. A material for this water shut-off pipe 17 is confined to the one among corrosion-resistant metallic materials which is capable of permanently holding a varied form adjusted to the wire cable smoothly movable when being inserted in the pipe. Such a material involves stainless, copper or the like. Hence, in case that deformation caused by formative distortion is created in a botton wall surface 8A and side wall surface 8B of the low tank 8, the respective rugged portions 17*a* of the water shut-off pipe 17 are locally compressed or expanded, and the water shut-off pipe 17 may be crooked in accordance with the formative distortion produced in the foregoing low tank 8. As a matter of course, the wire cable 10 is, naturally curved along the crooked configuration of the water shut-off pipe 17.

Figure 10:
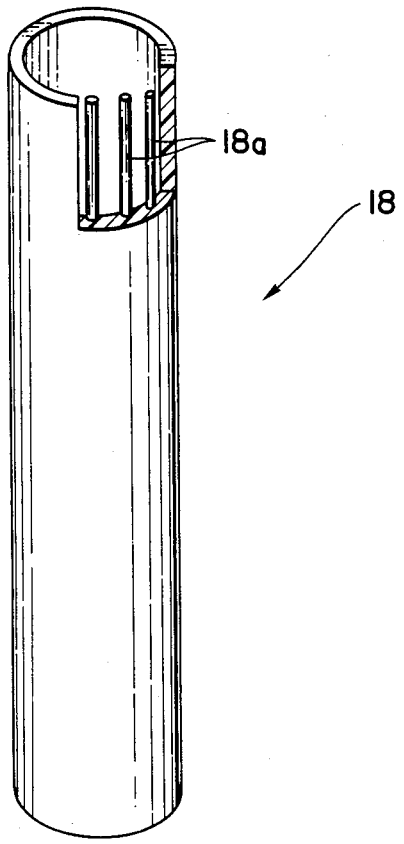
FIG. 10 is a perspective view showing another mode of a water shut-off pipe with portions broken away.

FIG. 10 is a perspective view, with portions broken away for clarity, showing a water shut-off pipe of another embodiment. The water shut-off pipe 18 composed of a flexible resinous material such as vinyl resin or the like takes a cylindrical shape; and a plurality of core wires 18*a* parallel to the axial line of the cylinder are embedded in thick portions of the resinous material. The core wires 18*a* are formed of a material which is capable of being permanently bent and varied in shape. Such a meterial implies, for instance, lead alloy, copper alloy or the like.

As is apparent on reading the description thus far made, according to the trapless water flush toilet bowl fixture relative to the embodiment of FIGS. 9, 10, the distortion created when manufacturing the water-supply tank can be absorbed by adjustably varying the shape of the flexible water shut-off pipe 17 at the time of it's being vertically provided.

FIGS. 11 to 14 inclusive are relative to still another preferred embodiment of the present invention. In this embodiment, as shown in FIGS. 11 to 14, a wire cable 27 is disposed in a sufficiently flexible state, between the operational member 22 and the water closet cesspool sealing member 24. A terminal 26*b* of an inner cable 26 provided on the side of the operational member 22 is connectively fixed to a rack 39 within a gear case 35: and a terminal of an outer cable provided on the side of the operational member 22 is connectively fixed to the case 35. On the other hand, a terminal 26*a* of the inner cable is loosely connected to a lever 30 through the intermediary of a rod 40 on the side of the water closet cesspool sealing member 24. A terminal of the outer cable 25 is connected through the intermediary of a screw 41 to a sleeve 42 that is slidably and externally fitted to the rod 40. An external thread 41*a* of the sleeve 42 is equipped through the intermediary of a nut 44 with a receiving plate 45 for a spring 37 intended to set a tensile load. A slide bush 43 is externally attached to the free end of the sleeve 42. The above-described spring 37 is spanned between the slide bush 43 and the receiving plate 45. The slide bush 43 is fixed via a terminal portion installing member (it consists of brackets 38*a*, 38*b*) to the casing 32 for the water closet cesspool sealing member 24.

In the second place, functions of the thus constructed water closet cesspool sealing member 24 will be described as follows.

Figure 11:
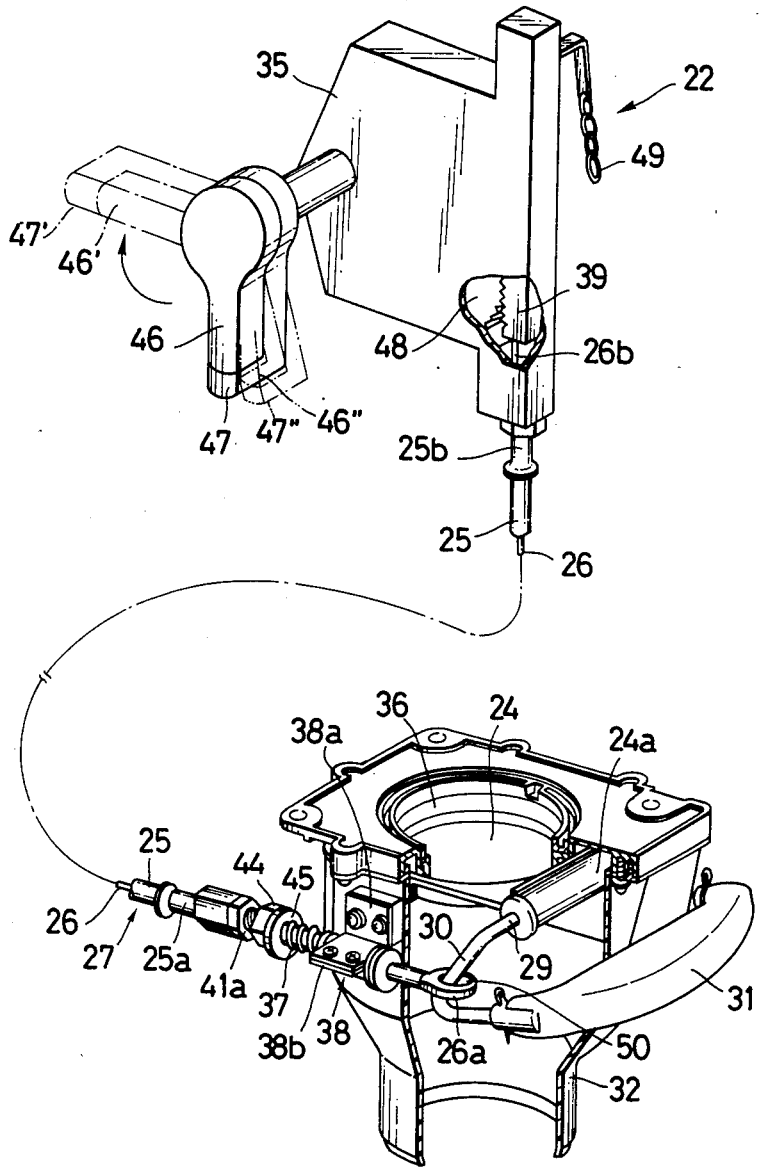
FIGS. 11 to 14 inclusive are relative to still another preferred embodiment.
Figure 12:
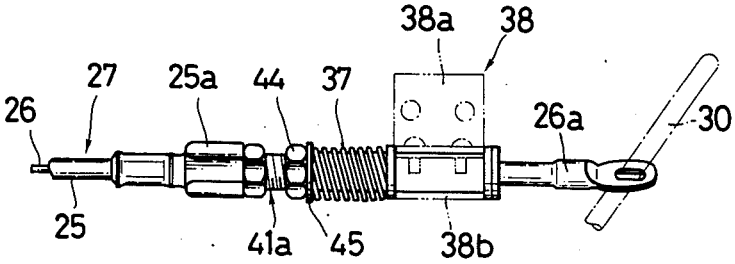
Figure 13:
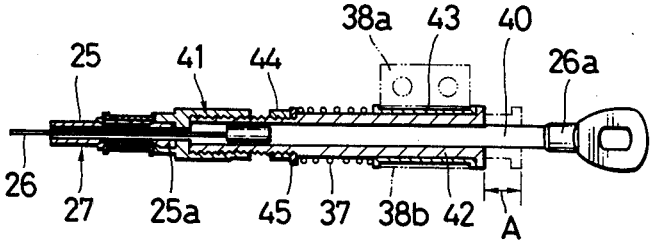
Figure 14:
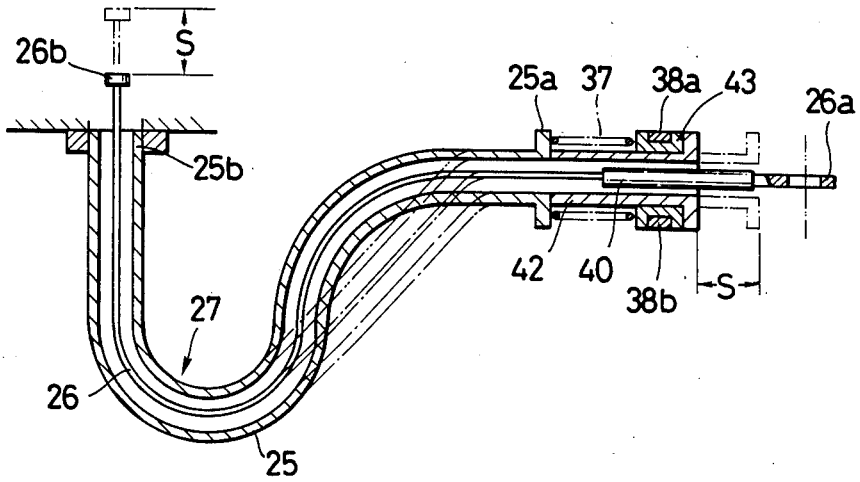

In case of effecting an ordinary rinsing operation of the trapless water flush toilet bowl fixture, the handles 46, 47 of the operational member 22 are turned to a position 46', 47' indicated by a one-dot line of FIG. 11. With this step, a fan-shaped pinion 48 rotates in the same direction, whereby the rack 39 is made to move rectilinearly in the lower direction of the Figure. Subsequently, the lever 30 is protrudently biased to the righ hand of the Figure by making use of the terminal 26*a* of the inner cable 26 connected to the rack 39; and with the rotary shaft 29 serving as the fulcrum, the water closet cesspool sealing member 24 is made to turn anticlockwise in the Figure. Then, the bowl 2 (See FIG. 1) is communicated with an evacuation pipe 15. On the other hand, a chain 49 that is to be connected to the float valve is linked to the other end of the shaft of the handle 46 which end penetrates the case 35. By virtue of the aforementioned turning operation, the float valve is raised, thereby supplying the rinsing water reserved in the tank into the bowl to clean it. After rinsing the bowl, the rinsing water then cleans the water closet cesspool sealing member 24 and flows through the evacuation pipe.

The handle 46 automatically reverts to a position indicated by a solid line of FIG. 11 by dint of the weight of its own. The water closet cesspool sealing member 24 rotationally reverts clockwise (sealed state) of FIG. 11 by the coil spring of the bottom opening mechanism 5, whereby the bottom-open handle 47 rotationally reverts to a position indicated by the solid line through the intermediary of the inner cable 26, the rack 39 and the pinion 48 such as to be concomitant with the previous step.

On the occasion of having emptied the feces the handle 47 is turned to a position 47" indicated by a two-dot line of FIG. 11. As a result, the rack 39 moves through the intermediary of the pinion 48 to the upper portion of the Figure, at which position the rack 39 is locked. The terminal 26*a* of the inner cable 26 connected to the rack 39 recedes to the left hand of the Figure, eliminating a clearance between the lever 30 and a hole 50 formed in the terminal 26*a*. Simultaneously, the water closet cesspool sealing member 24 comes in press-contact with a sealing material 36, thus forcibly sealing a gap between the bowl and the evacuation pipe. Subsequently, in this state the handle 46 is turned in the clockwise direction of FIG. 11, and the float valve is then raised to some extent. Resultingly, rinsing water is fed into the bowl 2 (See FIG. 1), whereby it is possible to gain an adequate height of level of the reserved water. Thereafter, the filth is discharged. The filth drops down into the water accumulated in the bowl, so that the filth is by no means brought into contact with the bowl 2. After the filth has been discharged, the handles 46, 47 are turned to the positions 46', 47' of one-dot lines of FIG. 11, and the rinsing operation may be effected in the same manner as usual. When evacuating the feces, it is feasible to obtain the sufficient height of level of the reserved water and hence there is no possibility for the filth to come in direct-contact with the inner surface of the bowl. In addition, the filth is easily removed from the bowl. Accordingly, the bowl can be maintained clean.

In the light of such a rinsing operation in the trapless water flush toilet bowl fixture, it is presumed that a stroke of the inner cable is larger than a preset-stroke because of dimentional errors created when manufacturing the inner cable 26, the outer cable 25, the operational member 22 or of dimentional errors produced when installing them. On the basis of this presumption, if the handle 47 is to be turned to the position 47" depicted by the two-dot line of FIG. 11, the water closet cesspool sealing member 24 impinges upon the sealing material 36 attached to the waste water discharge port formed in the bowl; and a further rotation is not made at all. Therefore, it can be considered that the terminal 26*a* of the inner cable 26 connected to the lever 30 is in a fixed state. Deflection of the inner cable 26 is, as shown in FIG. 4, corrected at its intermedaite portion so that the overall length of this deflection is shortened. The terminal 26b on the side of the operational member is projected upwards by a length (equivalent to the dimensional error) to which the deflection is corrected (a dimension S). The outer cable 25 has its terminal 25b on the side of the operational member, this terminal 25b being connected to the case 35 for the operational member 22. The outer cable 25 loses a space for escape which is equivalent to the dimension S to which the deflection is corrected and then presses the spring 37 for setting the tensile load on the side of the terminal 25a so such an extent that it juts out from the terminal installing member 38 to the right hand of FIGS. 12 to 14.

Inasmuch as the terminal 25a of the outer cable 25 is in a free state, it is feasible to correct the deflections of the inner cable 26 and the outer cable 25. Moreover, the correction is made after the tensile load acting on the outer cable 25 exceeds a preset-pressure of the spring 37 that the deflection is corrected. Hence, if the preset-pressure of the spring 37 be adjusted to an allowable limit value of torsional stress acting between the water closet cesspool sealing member 24 and the rotary shaft 29, it will be possible to eliminate an influence of the torsional stress that is greater than required, this influence being present therebetween. Videlicet, an external force exceeding the allowable value is prevented from working in a connecting portion 24a between the water closet cesspool sealing member 24 and the rotary shaft 29 and occurrence of cracks can therefore be prevented. It is to be noted that the aforecited limit value is ordinarily set to approximately 3 $Kg/cm^2$.

Figure 15:
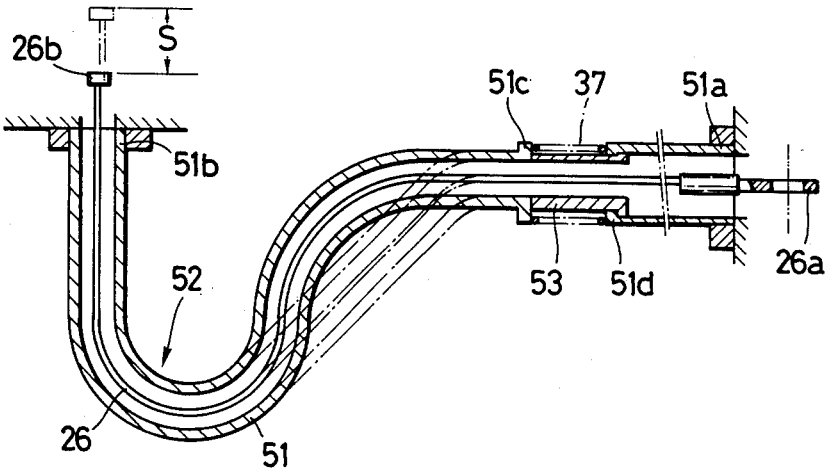
FIG. 15 is a vertical sectional view showing another mode thereof.

FIG. 15 is a vertical sectional view showing another mode of the operatio cable. In this case, both ends 51a, 51b of the outer cable 51 are fixed, and terminals 51c, 51d are provided at its intermediate portion. The terminal 51c is internally fitted in the terminal 51d throught the intermediary of a sleeve 53; and the spring 37 for setting the tensile load is provided between the terminals 51c, 51d. As in the case of the previous mode, if the stroke of the inner cable 26 is greater than the preset-stroke, the operation cable 52 is corrected in defelction to that degree. In such a case, since both the ends 51a, 51b of the outer cable 51 are fixed, the space for escape is lost, whereby a dimention between the terminals 51c, 51d at its intermediate portion is shortened, resisting the spring force of the spring 37. In this mode, too, it is not till the tensile load of the inner cable 26 exceeds the preset-pressure of the spring 37 that the deflection is corrected. If the preset pressure of the spring 37 is adjusted to the allowable limit value of the torsional stress acing between the water closet cesspool sealing member 24 and the rotary shaft 29, there is no probability for the torsional stress that is greater than needed to work therebetween. Other constitutions and operational effects are the same as those of the above-described embodiment of FIGS. 11 to 14 inclusive and the decription is therefore omitted for convenience.

In the embodiment of FIGS. 11 to 15 inclusive, even if there are dimentional errors created when manufacturing the components or when installing them in the mechanism by which to forcibly open and close the water closet cesspool sealing member, no torsional stress that is greater than needed acts between the water closet cesspool sealing member and the rotary shaft thereof. Consequently, the cracks are not produced at all in the installing portion of the rotary shaft of the water closet cesspool sealing member.

FIGS. 16 to 19 inclusive are relative to a further preferred embodiment of the present invention, In the Figures, the same components as those shown in FIGS. 11 to 15 are marked the same numerals and symbols. In FIGS. 16 to 19, the terminal 25a of the outer cable 25 is connected with the aid of a sleeve 71 and a fatening 70 to the bracket 38 secured to the body casing 32. The terminal 26a of the inner cable 26 is equipped with a cable length adjusting mechanism 61. This cable length adjusting mechanism 61 subsumes a slot 64 into which the lever 30 is inserted and a cylindrical body 72 formed with an axial hole 65 which communicates with the slot 64. The axial hole 65 is provided with the moving member 62 and the spring 63 for setting the tensile load which yields its spring force in the direction against the tensile load whereby the moving member 62 acts on the inner cable 26. The reference numeral 73 stands for a metal fittings designed for shutting off the opening end portion of the above-described axial hole 65. The lever 30 intended to turn the water closet cesspool sealing member 24 is so provided as to pass through the above-described slot 64.

An operational mode of the thus constructed water closet cesspool sealing member 24 will hereinafter be described.

Figure 16:
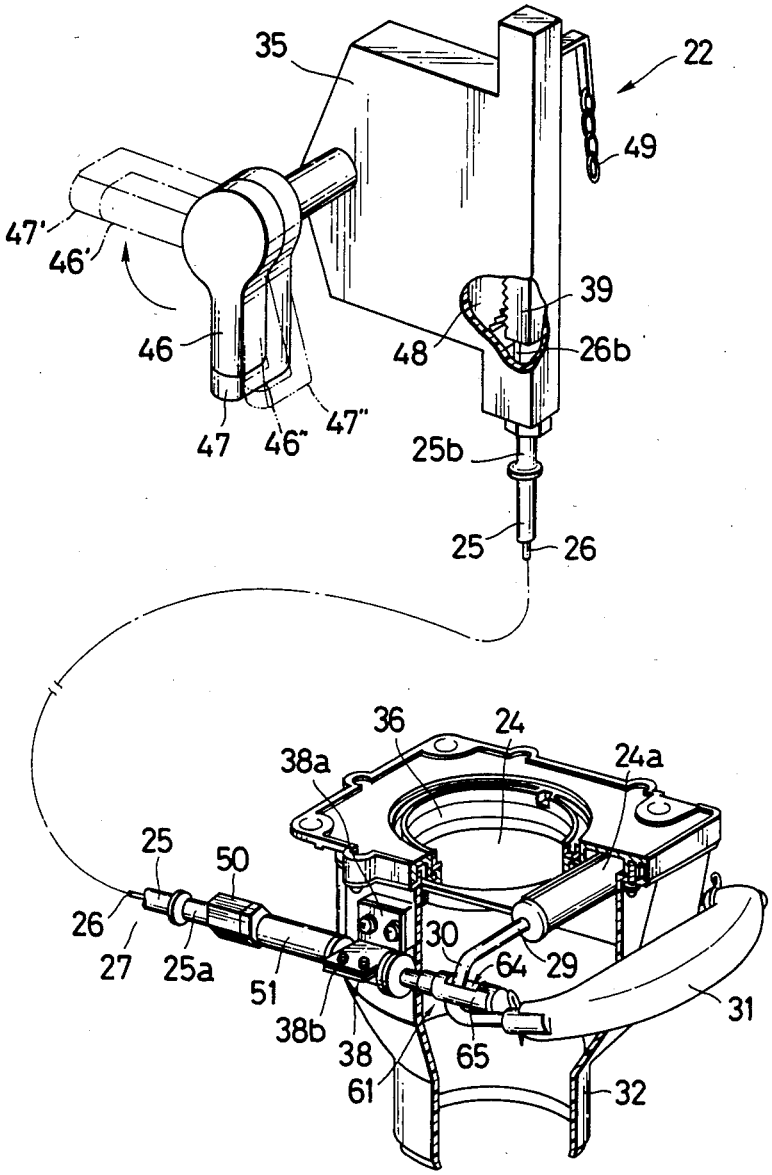
FIGS. 16 to 19 inclusive show a further preferred embodiment.
Figure 17:
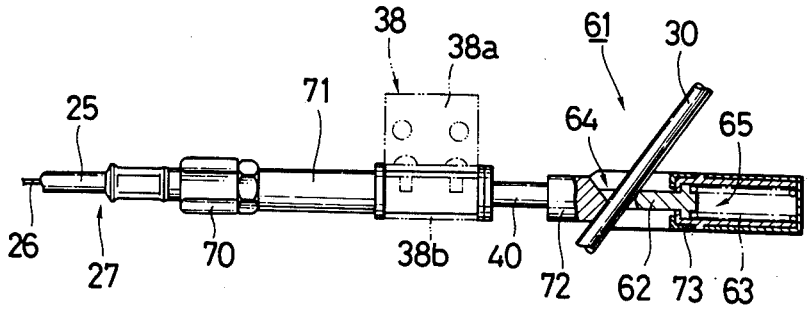

To start with, when usually cleaning the trapless water flush toilet bowl fixture, the handles 46, 47 of the operational member 22 are turned to positions 46', 47' of one-dot lines of FIG. 16. With this step, the pinion 48 rotates in the same direction as that of the handles 46, 47 thereby to rectilinearly move the rack 39 in the lower direction of the Figure. As a result of this process, the cable length adjusting mechanism 61 mounted on the side of the terminal 26a of the inner cable 26 protrusively biases the lever 30 to the right hand of the Figure, thereby rotating the water closet cesspool sealing member 24 in the counterclockwise direction of the Figure, with the rotary shaft 29 serving as the fulcrum. Owing to this step, the bowl 2 (See FIG. 1) is made to communicate with the evacuation pipe. While, the chain 49 that is to be connected to the float valve is linked to the other end of the shaft of the handle 46 which end penetrates the case 35. When the float valve is raised by virtue of the above-mentioned rotational operation, the rinsing water accumulated in the tank is supplied into the bowl to clean it. After cleaning the bowl, the rinsing water cleans the water closet cesspool sealing member 24 and then flows into evacuation pipe.

After the rinsing operation has been completed, the float valve is seated upon receivng suctorial effects of the rinsing water flowing from the tank into the bowl, and concomitantly the handle 46 automatically reverts to a position indicated by the solid line of FIG. 16. On the other hand, the handle 47 rotationally reverts to a position indicated by the solid line of the same Figure by dint of the spring force of a torsional coil spring (not illustrated) incorporated in the case 35 and by the load of the heavy sinker 31.

On the occasion of having emptied the feces, the handle 47 is turned to a position 47'' of the two-dot line of FIG. 16. In such a case, the operations are the indentical with those of FIGS. 11 to 15 inclusive.

In the light of performing the bowl cleaning operation in this manner, it is presumed that the stroke of the inner cable 26 is greater than the preset-storke on account of the dimensional errors produced when manufacturing the inncer cable 26, the outer cable 25 and the operational member 22 or when installing them.

Figure 18:
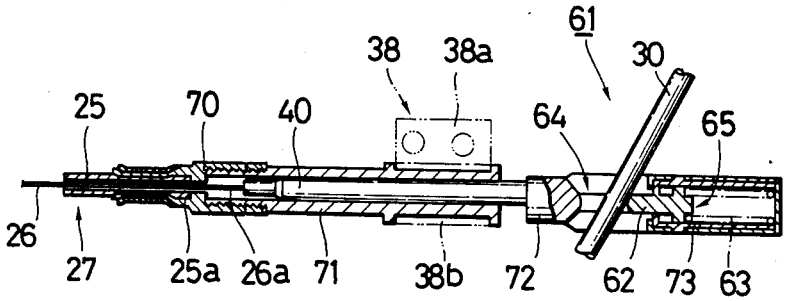
Figure 19:
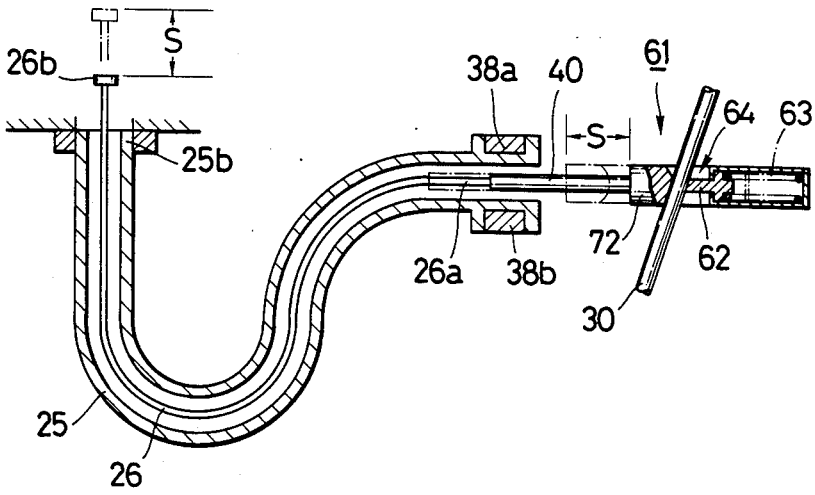

On the basis of this presumption, if the bottom-open handle 47 be turned to a position 47" indicated by the two-dot line of FIG. 16, the water closet cesspool sealing member 24 impinges upon the sealing material 36 attached to the waste water discharge port formed in the bowl and a further rotation is never made. Hence, it may be considered that the lever is fixed. As illustrated in FIG. 19, when the terminal **26*b* of the inner cable 26 is further stretched (it is made to move upwards in the Figure) from the above-described state, the moving member 62 impinging upon the fixed lever 30 presses the spring 63 in proportion to the tensile load of the inner cable 26. Resultingly, the terminal 26*b* of the inner cable 26 moves upwards in the Figure to such an extent that the spring is pressed. As a matter of course, the terminal 26*b* moves by a surplus stroke S of the inner cable 26 from the position indicated by the solid line of FIG. 19. Hence, the dimension obtained when the moving member 62 presses the spring for setting the load is equal to the aforementioned dimension S, and inevitably the cylinder body 72 moves by the dimension S to the left hand of FIG. 19. After the movement has been made, the very conditions described in FIG. 18 are present there. After all, the inner cable 26 is, in other words, extended in effective cable length by the above-mentioned dimension S. Movement of the moving member 62 does not occur the tensile load acting on the inner cable 26 exceeds the preset pressure of the spring 63. Therefore, if the preset-pressure of the spring 63 be adjusted to the allowable limit value of the torsional stress acting between an installing portion 24*a* of the water closet cesspool sealing member 24 and the rotary shaft 29**, it is feasible to eliminate the effects by the torsional stress that is greater than required, these effects existing therebetween. It is to be noted that the above-described allowable limit value is ordinarily set to 3 $Kg/cm^2$ or thereabouts.

In short, the cable length adjusting mechanism 61 in this emobodiment is arranged such that, when the load acting on the inner cable 26 exceeds the allowable limit value of the torsional stress working between the water closet cesspool sealing member 24 and the rotary shaft 29, the effective cable length of the inner cable 26 is adjusted in accordance with the aforecited load so as to prevent the torsional stress that is greater than needed from acting between the water closet cesspool sealing member 24 and the rotary shaft 29.

In this embodiment of FIGS. 16 to 19, the cable length adjusting mechanism 61 may be provided on the side of the terminal **26*b* of the inner cable 26**.

As described above, even in the emobodiment of FIGS. 16 to 19, it is found out that there is produced a phenomenon in which the manipulation handle of the rinsing operational mechanism becomes extremely heavy in operation when a radius of curvature of the drive conveying device is 50 mm or less. In the present invention, it is preferable that the sharpest curvature of the drive conveying device be constantly 50 mm or more. It is observed that the radius of curvature which is more than 50 mm contributes to a reduction in operational force of the manipulation handle.

Figure 20:
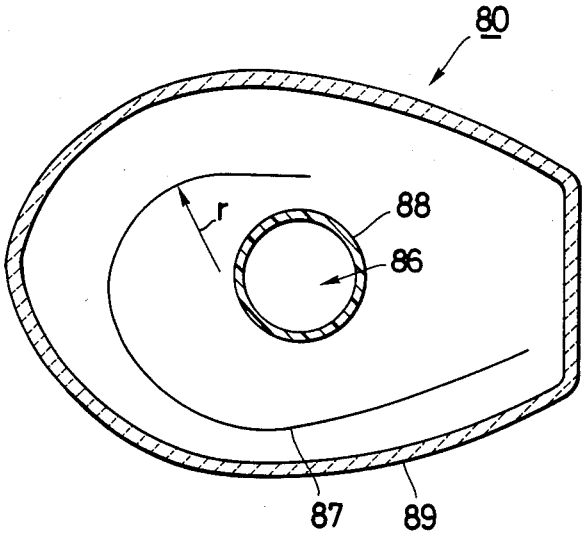
FIG. 20 is a sectional view in plane showing the trapless water flush toilet bowl fixture of a still further preferred embodiment.

FIG. 20 is a sectional view in plane showing a floor placement portion 89 of the trapless water flush toilet bowl fixture body 80 relative to a still further preferred embodiment. In the Figure, the wire cable 87 is schematically illustrated. A ring-shaped sectional portion 88 disposed at a substantially central part of the floor placement portion 89 implies an evacuation tube. A curvature radius $\gamma$ of the wire cable 87 is 50 mm or more. The value of the curvature radius of the wire cable 87 is prescribed with respect to the line of central axis and at the same time is applied to all the crooked portion formed on the front periphery of the waste water discharge port. A diameter of the inner cable employed for constituting the wire cable 87 falls within a range of 1 to 2 mm, which value is sufficient for a small operational force to open the water closet cesspool sealing member 86 and is convenient to its treatment. When the wire cable including the inner cable with such a diameter is bent by the curvature radius of 50 mm or less, a contact-pressure of the inner cable on the tube inner wall is strikingly heightened, thereby increasing its slide-resistance. Consequently, it is found out that the manipulation handle 6 (See FIG. 3) becomes heavy.

A front external configuration of the trapless water flush toilet bowl fixture can not be changed into a front-expanded shape on account of requiring a stand-space when men empty the bladder or a feet-put space when sitting on the stool. The maximum of the radius of curvature pertaining to the wire cable is inevitably confined to numerical values which permit it to be housed in the trapless water flush toilet bowl fixture body. Generally speaking, the radius of curvature ranges from 200 to 400 mm.

Figure 21:
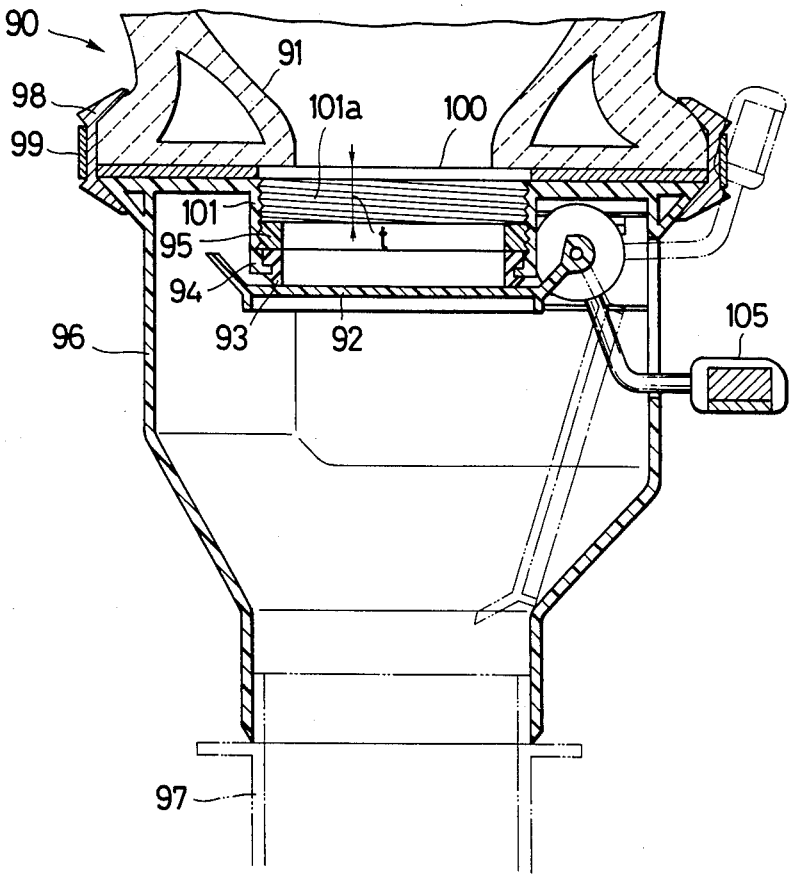
FIGS. 21 to 23 inlcusive are relative to a more additional preferred embodiment.

FIG. 21 is an enlarged sectional view, of a principal portion, showing one aspect of a seal-packing attachment structure of the trapless water flush toilet bowl fixture accoring to the present invention. The trapless water flush toilet bowl fixture 90 includes the bowl 91 whose bottom surface is formed with the waste water discharge port 100. A casing 96 housing the water closet cesspool sealing member 92 is provided at the lower portion of the above-described waste water discharge port 100. The casing 96 performs a function to connect the evacuation pipe 97 communicating with the cesspool to the trapless water flush toilet bowl fixture 90. The water closet cesspool sealing member 92 is given an upward pushing force such as to impinge from underside upon the waste water discharge port 100 by the shut-off forcible sinker 105. The water closet cesspool sealing member is opened by the foregoing forcible opening mechanism, but this mechanism is not illustrated in FIG. 21.

At the bottom surface of the bowl 91, the trapless water flush toilet bowl fixture 90 is joined to the upper surface of the casing 96 by means of a clamp 98 and a fatening band 99 or the like. As a matter of course, it is possible to effect this junction by employing a bolt and a nut. A seal-packing attachment member 101 is so provided at the upper portion of the casing 96 as to be connected to the waste water discharge port formed in the bottom surface of the bowl. The seal-packing attachment member 101 involves a cylindrical member that is so provided as to be vertical to the upper surface of the aforementioned casing 96, the inside diameter of which is the same or slightly larger than an aperture of the waste water discharge port. An annular protrudent seizing member 94 for the seal packing 93 which juts out inwards is provided at the lower end of the seal-packing attachment member 101. An inner periperal surface **101*a* of the seal-packing attachment member 101 is formed with an internal thread with which the packing holding fittings 95 engages. A length of the internal thread is set enough to obtain gap distance t at which the seal-packing 93 can be replaced in an attachable-and-detachable manner when the packing holding fittings 95 is spaced from the seal-packing 93**.

Figure 22:
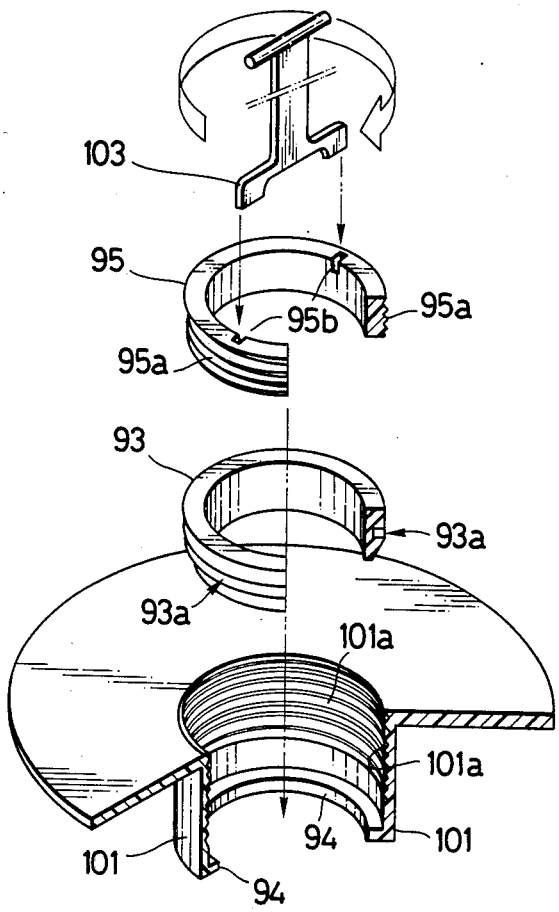
Figure 23A:
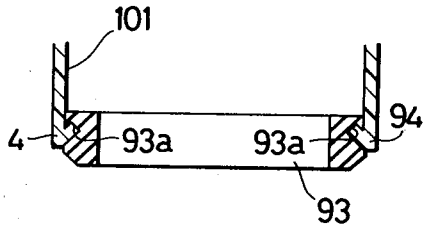
Figure 23B:
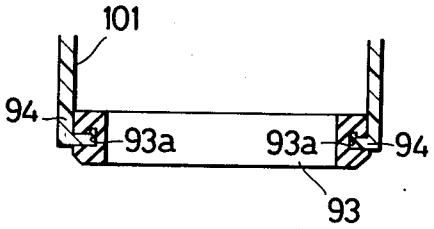
Figure 23C:
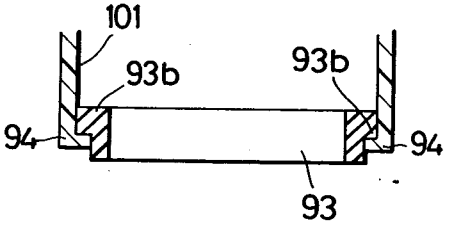
Figure 23D:
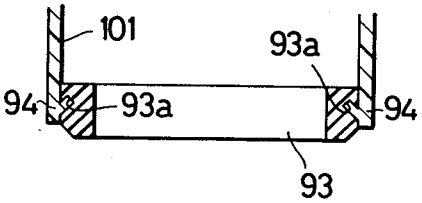
Figure 23E:
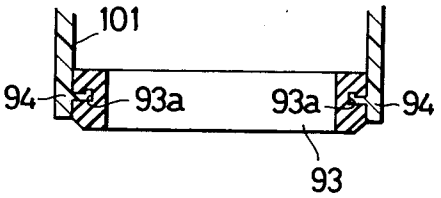
Figure 23F:
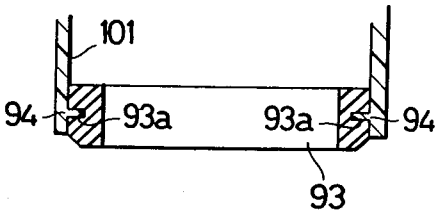

FIG. 22 is a perspective view showing the packing holding fittings 95, the seal-packing 93 and the seal-packing attachment member 101.

The ring-shaped seal-packing 93 is composed of flexible fluorine rubber or the like. The outside diameter of the seal-packing 93 substantailly coincides with the inside diameter of the seal-packing attachment member 101, the inside diameter of which is the same or slightly larger than the aperture of the waste water discharge port 100. The outer peripheral surface is formed with a seizing groove 93*a* for fitting the seizing member 94 therein. When the seizing member 94 is fitted in the seizing groove 93*a*, the lower end of the seal-packing 93 is rendered slightly more protrudent than the lower end of the seal-packing attachment member 101, thereby sealing the gap between the evacuation portion of the trapless water flush toilet bowl fixture 90 and the water closet cesspool sealing member 92.

Similarly, the ring-shaped packing holding fittings 95 has almost the same inside and outside diameters as those of the seal-packing 93, the outer peripheral surface of which is provided with an external thread 95*a* corresponding to the internal thread formed in the inner peripheral surface of the seal-packing attachment member 101. The upper surface portion of the packing holding fittings 95 is formed with a notch groove 95*b* for rotation. Therefore, the packing holding fittings 95 is engaged with the inner peripheral surface of the seal-packing attachment member 101; and a rotation tool 103 is, as illustrated in FIG. 22, employed. With this step, it is possible to carry out the pressing operation and the distant operation of the packing holding fittings 95 with respect to the seal-packing 93.

The initial attachment of the seal-packing 93 prior to installing the trapless water flush toilet bowl fixture 90 into the toilet room is performed such that, after the seizing member 94 of the seal-packing attachment member 101 has been completely fitted in the seizing groove 93*a* of the seal-packing 93, the packing holding fittings 95 is engaged with the internal thread formed in the inner peripheral surface 101*a* of the seal-packing attachment member 101 and is then fastened, thereby pressing the seal-packing 93.

The seal-packing 93 starts deteriorating within a few years after the trapless water flush toilet bowl fixture 90 has begun to be utilized, so that it is necessary to replace it with a new seal-packing. A method of replacing the seal-packing 93 is described as follows.

While letting the installation state of the trapless water flush toilet bowl fixture remain as it is, the packing holding fittings 95 engaging with the inner peripheral surface of the seal-packing attachment member 101 is made to rotate from the inside of the bowl 91 by means of the rotatiopn tool or the like thereby to separate it from the seal-packing 93. In the wake of this, the seal-packing 93 is removed from the seizing member 94. In this case, since the seal-packing is invested with flexibility, it can be pulled out from the waste water discharge port 100 by a hand or a proper tool, the discharge port 100 having the aperture which is the same or slightly smaller than the outside diameter of the seal packing 93. The subsequent attachment of a new seal-packing may be performed in the reversed order of the aforementioned steps. Namely, the seal-packing 93 is pushed from the waste water discharge port 100 of the bowl 91 into the the seal-packing attachment member 101 by making the most of the flexibility thereof and is then pushed down till the seizing groove 93*a* engages with the seizing member 94 while taking a posture of the seal-packing 93 into consideration. After the seizing groove 93*a* has engaged with the seizing member 94 to be seized, the packing holding fittings 95 is rotated once more, thereby pressing the seal-packing 93.

An attachment structure of the seal-packing according to the present invention is not confined to the foregoing description, but may be applied in many ways. For instance, the structures of the seizing groove 93*a* of the seal-packing 93 and the seizing member 94 of the seal-packing attachment member 101 can be varied into the configurations illustrated in FIGS. 23(*a*) to 23(*f*). Namely, the seizing member 94 is provided not only at the lower end of the seal-packing attachment member 101 (FIGS. 23(*a*), 23(*b*), 23(*c*)) but also at the portion that is little bit higher than the lower end of the seal-packing attachment member 101 (FIGS. 23(*d*), 23(*e*), 23(*f*)). Assuming that the tip end portion of the seizing member 94 is formed with a slant portion directed upwards (FIGS. 23(*a*), 23(*d*)), the tip end portion of the seizing member 94 is vertically provided with a rib for preventing the removal (FIGS. 23(*b*), 23(*e*)); and moreover, without forming the seizing groove, a collar 93*b* designed for seizing is, as shown in FIG. 23(*c*), peripherally provided on the upper portion of the outer periphery of the seal-packing 93 with a view to being caught by the seizing member 94.

As described above, in this embodiment, the seal-packing can be replaced without removing the trapless water flush toilet bowl fixture and hence it is possible to immediately take a measure to the deterioration thereof. Since the sealing of the discharging portion of the trapless water flush toilet bowl fixture is invariably kept in a good condition, an offensive odor and a blow-up wind are surely shut off, and further mosquitoes are of a certainty prevented from entering the toilet room. As shown in the Figures, if the aperture of the waste water discharge port of the bowl be the same or slightly smaller than the inside diameters of the seal-packing and the packing holding fittings, it is feasible to prevent the filth from adhering to the inner peripheral surface of the seal-packing attachment member. What's more, inasmuch as the packing holding fittings is never separated when slackening it, the packing holding fittings is by no means lost because of a mistaken operation; and the inner part of the waste water discharge port is unlikely to be visible, this leading to an improvement in appearance.

Figure 24:
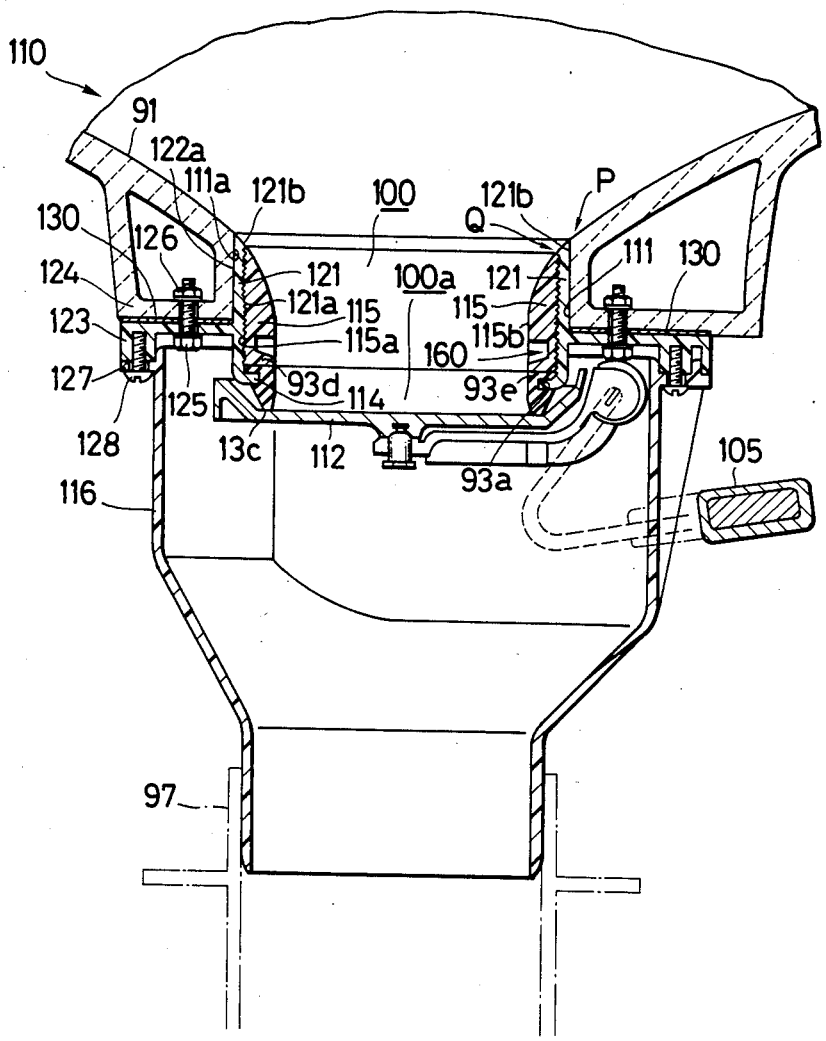
FIGS. 24 to 26 are relative to a still more additional preferred embodiment.
Figure 25:
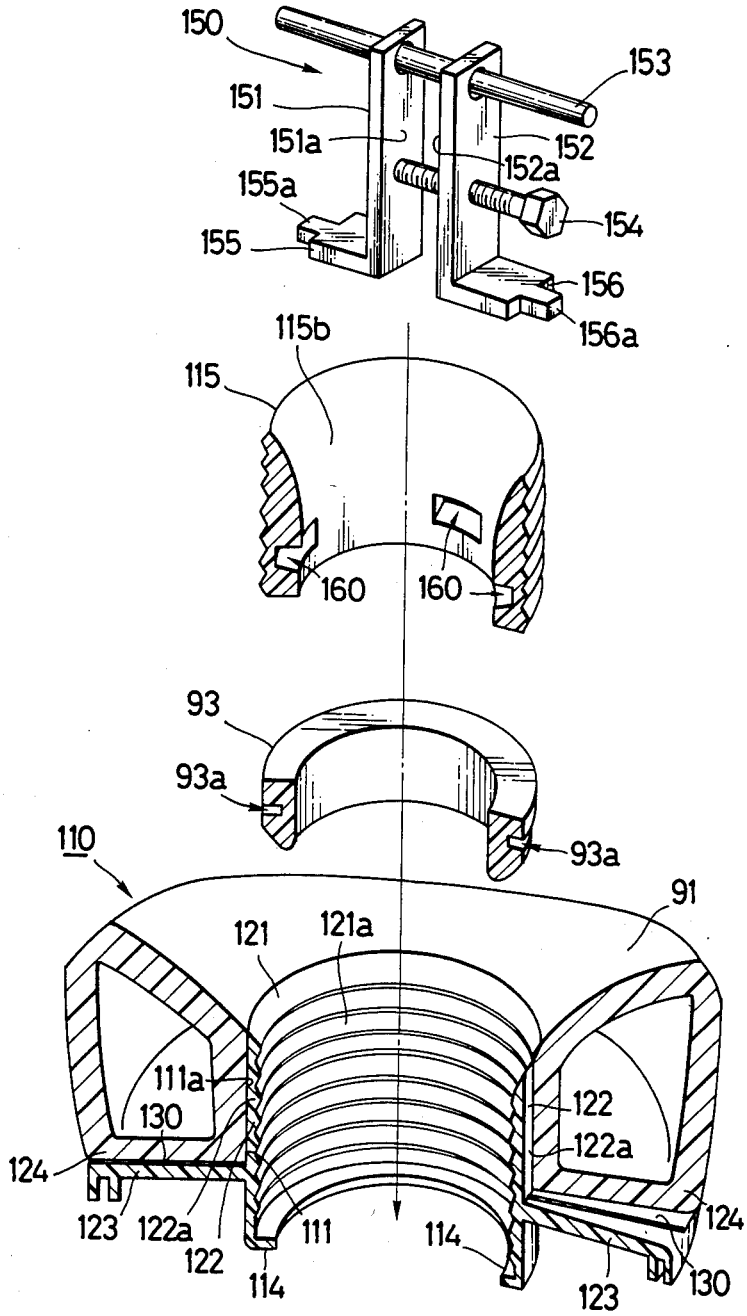
Figure 26:
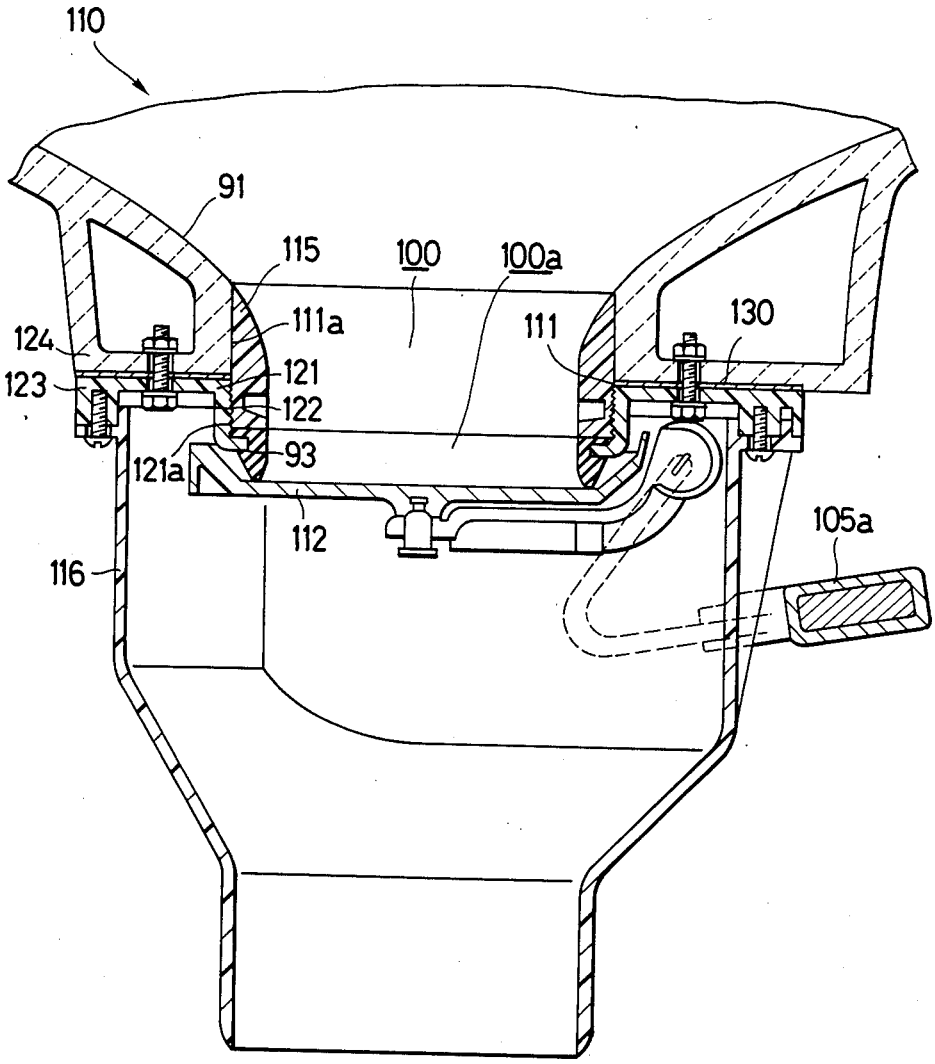

FIGS. 24 to 26 in combination show still more additional preferred embodiment pertaining to the embodiment of FIGS. 21 to 23. In these embodiments, a part of the common components are marked with the same numerals and symbols.

FIG. 24 is an enlarged sectional view showing a principal portion of the trapless water flush toilet bowl fixture of this embodiment. The casing 116 housing the water closet cesspool sealing member 112 is provided beneath the trapless water flush toilet bowl fixture 110. The casing 116 performs a function to connect the evacuation pipe 97 communicating with the cesspool to the trapless water flush toilet bowl fixture 110. The sinker 105 imparts an upward force to the water closet cesspool sealing member 112, whereby this sealing member 112 is pressed from underside against the waste water discharge port 111. The water closet cesspool sealing member 112 is opened through the instrumentality of the forcible open mechanism, but this mechanism is not illustrated in FIG. 24. The packing attachment member 121 is provided between the waste water discharge port 111 of the trapless water flush toilet bowl fixture 110 and the above-mentioned casing 116. The packing attachment member 121 formed of resin or the like consists of a cylindrical member 122 the outside diameter of which is substantially the same as the inside diameter of the waste water discharge port 111 and of a flange 123 formed on the side surface of the cylindrical member 122. The upside of the cylindrical member 122 is inserted in the waste water discharge port 111 of the trapless water flush toilet bowl fixture 110; and at the same time the flange 123 and a fixture bottom 124 are fastened with the bolts 125 and the nuts 126 through the intermediary of a seat-like packing 130, thereby joining the packing attachment member 121 to the above-described bowl fixture 110. Alternatively, instead of the bolt fastening operation, it is possible to fixedly bond an outer peripheral surface 122*a* of the cylindrical member 122 to an inner peripheral surface of the waste water discharge port 111. Moreover, the packing attachment fittings 121 is joined to the casing 116 by fixing the flange 123 to the collar 127 provided on the side surface of the casing 116 by means of a screw 128.

At the lower end of the packing attachment member 121 is provided the annular protrudent seizing member 114 jutting out inwards, the inner peripheral surface 111*a* of which is formed with the internal thread.

The ring-shaped seal-packing 93 composed of flurine rubber is invested with flexibility, and the outside diameter is nearly the same as the inside diameter of the packing attachment member 121. An annular groove 93*a* is formed in the outer peripheral surface of the seal-packing 93, this annular groove engaging with the seizing member 114. At this time, the lower end of the seal-packing 93 is rendered slightly more protrudent than the lower end of the packing attachment member 121 so as to come in close contact with the upper surface of the water closet cesspool sealing member 112, thereby sealing the gap between the waste water discharge port 100 and the water closet cesspool sealing member 112.

The annular packing holding fittings 115 has its inside and outside diameters that are roughly the same as those of the seal-packing 93. In this embodiment, the packing holding fittings 115 has a length extending from an upper surface 93*d* of the seal-packing 93 to an upper end 121*b* of the packing attachment member 121. An outer peripheral surface 115*a* of the packing holding fittings 115 is formed with the external thread corresponding to the aforecited internal thread formed in the inner peripheral surface of the packing attachment member 121, this external thread engaging with the inner peripheral surface 121*a* of the packing attachment member 121. Since a groove for a rotational operation or a bore 160 with the same purpose is formed or bored in the inner peripheral surface 115*b* of the packing holding fittings 115, it is possible to fasten and unfasten the packing holding fittings 115 by employing a rotation manipulatory tool 150 shown in FIG. 25, this tool being mentioned later. The upper end aurface 121*b* of the packing attachment member 121, each of the inner peripheral surface 115*b* of the packing holding fittings 115 and the inner peripheral surface 93*e* of the seal-packing 93 assumes a smoothly curved configuration extending from the inner surface of the bowl 91. Hence, the filth is discharged without delay, so that no filth remains in a border P between the packing attachment member 121 and the trapless water flush toilet bowl fixture 110 and in a border Q between the packing attchment member 121 and the packing holding fittings 115.

Secondly, a method of attching and detaching the seal-packing 93 will be described with reference to FIG. 25.

The initial attachment of the seal-packing 93 is carried out before installing the trapless water flush toilet bowl fixture 110 on the floor in the toilet room. At the first onset, the packing attachment member 121 is installed in the waste water discharge port 111 of the trapless water flush toilet bowl fixture 110. As explained earlier, this installation requires a method wherein the outer peripheral surface 122*a* of the cylindrical member 122 is bonded to the inner peripheral surface 111*a* of the waste water discharge port 111, or the flange 123 is fixed through the intermediary of the seat-like packing 130 to the bowl fixture bottom 124 by employing the bolts and the nuts. Subsequently, after the annular groove 93*a* of the seal-packing 93 has been made to engage with the seizing member 114 of the packing holding fittings 115, the packing holding fittings 115 is fitted in the internal thread formed in the inner peripheral surface 121*a* of the packing attachment member 121 and is then fastened by the rotation manipulatory tool 150, thus press-fixing the seal-packing 93.

The above-described rotation manipulatory tool 150 is constituted by two pieces of L-shaped members 151, 152 whose rear surfaces are disposed vis-à-vis with each other, an operational handle 153 and a hexagon headed bolt 154 for adjusting a space between the L-shaped members 151, 152. The tip ends of base portions 155, 156, of the L-shaped members 151, 152 are formed with projections 155*a*, 156*a*. These projections 155*a*, 156*a* are inserted in the grooves or bores 160 formed in adequate places of the packing holding fittings 115; and the space between the L-shaped members 151, 152 is adjusted by employing the hexagon headed bolt 154, thereby effecting the rotational operation of the packing holding fittings 115.

The rotation manipulatory tool is not confined to the aforegoing configuration, but other tolls designed for rotation may, as a matter of course, be utilized.

As explained earlier, it is necessary to replace the seal-packing 93 within a few years after the trapless water flush toilet bowl fixture 110 has been brought into utilization. Such being the case, the replacement of, the seal-packing 93 is made according to the following procedures.

To start with, while letting the installation condition of the trapless water flush toilet bowl fixture 110 remain as it is, the packing holding fittings 115 is made to rotate from the inside of the bowl 91 by making use of the rotation manipulatory tool 150 and is removed from the packing attachment member 121. In the second place, the seal-packing is pulled out by a hand or by a proper tool, making the most of its flexibility. Subsequently, a new seal-packing 93 is attached by effecting the above-mentioned steps in the reversed order. That is to say, the seal-packing 93 is pushed into the packing attachment member 121 by utilizing the flexibility thereof; the annular groove 93*a* is engaged with the seizing member 114; and the packing holding fittings 115 is fitted in the packing attachment member 121 once more and is then fastened, thus fixing the seal-packing 93.

In this embodiment, as shown in FIG. 26, there may be adopted a structure wherein the cylindrical member 122 of the packing attachment member 121 is not inserted in the waste water discharge port 111 of the trapless water flush toilet bowl fixture 110. In this case, the cylindrical member 122 having an inside diameter that is roughly the same as the aperture of the waste water discharge port 111 is so provided in the flange 123 of the packing attachment member 121 as to jut out downwards. Then, the packing attachment member 121 is fitted to the bowl fixture bottom 124; and the packing holding fittings 115 is installed along the inner peripheral surface 111*a* of the waster water discharge port 111 and the inner peripheral surface 121*a* of the cylindrical member 122, thereby forming a smoothly curved configuration extending from the inner surface of the bowl 91 to an lower opening 100*a*.

As can be clarified from the description thus far made, the embodiment described in FIGS. 24 to 26 inclusive yields advantages similar to those of the embodiment of FIGS. 21 to 23 inclusive. In addition, there is formed a surface configuration that is consecutively smooth, the configuration extending from the inner surface of the bowl to the waste water discharge port. By virtue of this characteristic, it is feasible to prevent both the filth from adhering thereto and the offensive odor from being produced, and to enhance sanitary effects.

What is claimed is:

1. A trapless water flush toilet bowl fixture comprising, a bowl having a waste water discharge port at a bottom portion thereof, cylindrical means attached to the discharge port of the bowl to allow materials in the bowl to pass therethrough, said cylindrical means having one of concave groove and rib at a lower portion thereof, a seal packing attached to the lower portion of the cylindrical member, said seal packing having one of rib and concave groove to engage said one of concave groove and rib respectively so that the seal packing can be attached to and detached from the cylindrical means through the inside of the cylindrical means, closing means for blocking the waste water discharge port, said closing means including a disk-like member situated adjacent to the bowl to pivot thereto, said disk-like member abutting against the seal packing from underside thereof, and a sinker connected to one end of the dish-like member so that the sinker urges the disk-like member to abut against the seal packing, said disk-like member, when a predetermined amount of weight is applied to the dish-like member, being able to pivot relative to the bowl to open the waste water discharge port, and operation means for opening the waste water discharge port, said operation means being connected to the dish-like member so that when the operation means is actuated, the dish-like member pivots to allow materials on the dish-like member to drop.

2. A trapless water flush toilet bowl fixture as set forth in claim 1, wherein said operation means includes a valve handle for controlling water supply to the bowl, a bottom-open handle for controlling movement of the dish-like member, and a cable connected between the bottom-open and the disk-like member, said. fixture further including a water tank and a pipe situated inside the water tank to prevent water from entering into the pipe, said cable passing through the pipe and connected to the bottom-open handle.

3. A trapless water flush toilet bowl fixture as set forth in claim 2, wherein said pipe is deformable by applying force and is capable of maintaining the deformed configuration while said pipe is disposed within said tank for a long period of time.

4. A trapless water flush toilet bowl fixture as set forth in claim 2, wherein said cable subsumes an tube-like flexible outer cable and a flxible inner cable inserted in said outer cable, said inner cable being capable of sliding in the direction of its axial line within said outer cable.

5. A trapless water flush toilet bowl fixture as set forth in claim 4, wherein said cable is disposed in a sufficiently flexible state; a free-state terminal is formed on said outer cable; and a spring for setting a tensile load is provided on said terminal, so that a rotational force which is smaller than a preset-value is applied on said closing means on account of said spring being deformed when a load that is greater than a preset-pressure of said spring is applied on said outer cable.

6. A trapless water flush toilet bowl fixture as set forth in claim 4, wherein a moving member is provided at a terminal of at least one end of said inner cable which moving member is biased in the direction opposite to the direction of application of the tensile load by a spring for setting said tensile load; and a lever for turning said closing means is interposed between said moving member and said inner cable, so that said rotational force which is smaller than said preset-value is applied on said closing means because of said spring being deformed when the load acting on said inner cable is greater than said preset-pressure.

7. A trapless water flush toilet bowl fixture as set forth in claim 4, wherein a radius of curvature of said cable is 500 mm or more.

8. A trapless water flush toilet bowl fixture as set forth in claim 1, wherein a ring-shaped packing holding means for holding said seal-packing from above is attached to an inner peripheral surface of said cylindrical member.

9. A trapless water flush toilet bowl fixture as set forth in claim 8, wherein an aperture of said waste water discharge port formed in said bowl bottom is the same or slightly smaller than both an inside diameter of said seal-packing and an inside diameter of said packing holding means.

10. A trapless water flush toilet bowl fixture as set forth in claim 8, wherein an outside diamter of said packing holding means is smaller than said aperture of said waste water discharge port of said bowl.

11. A trapless water flush toilet bowl fixture as set forth in claim 8, wherein a curved surface extending from an inner surface of said bowl to a lower opening of said seal-packing is consecutively smooth in configuration.

12. A trapless water flush toilet device comprising, a water tank, a bowl connected to the water tank and having a waste water discharge port at a bottom portion thereof, closing means for blocking the waste water discharge port, said closing means including a dish-like member attached to the bowl to abut against the waste water discharge port from underside thereof and a sinker connected to one end of the dish-like member so that the sinker urges the dish-like member to abut against the waste water discharge port, said dish-like member, when a predetermined amount of weight is applied to the dish-like member, being able to pivot relative to the bowl to open the waste water discharge port, and operation means for controlling the closing means and an amount of water to be flushed, said operation means including a valve handle for controlling water supply from the water tank to the bowl, a bottom-open handle, a cable connected between the bottom-open handle and the dish-like cable so that when the bottom-open handle is actuated in one direction, the cut-off mechanism operates to prevent movement of the dish-like member even if a large amount of weight is applied to the dish-like member, and when the bottom-open handle is actuated in the other direction, the cut-off mechanism is released and the dish-like member is pivoted to open the waste water discharge port.

13. A trapless water flush toilet device as set forth in claim 12, wherein said operation means further includes a rack attached to the cable, said bottom-open handle engaging the rack.

14. A trapless water flush toilet device as set forth in claim 13, wherein said cut-off mechanism comprises at least one seizing groove formed on a lower portion of the rack, a hook situated at the opposite side of the seizing groove, and a spring attached to the hook to urge the hook toward the seizing groove, said hook, when the rack is moved upwardly by means of the bottom-open handle, engaging the seizing groove to thereby lock the dish-like member.

15. A trapless water flush toilet device as set forth in claim 14, wherein said valve and bottom-open handles are engaged together so that while the valve handle can move freely relative to the bottom-open handle, when the bottom-open handle is move to release the cut-off mechanism, the valve handle is moved together with the bottom-open handle.

* * * * *